United States Patent [19]

Miyakoshi et al.

[11] Patent Number: 4,470,379

[45] Date of Patent: Sep. 11, 1984

[54] MULTI-CYLINDER ENGINE

[75] Inventors: Shinichi Miyakoshi, Saitama; Kuniyuki Yamamoto, Tokyo, both of Japan

[73] Assignee: Honda Giken Kogyo Kabushiki Kaisha, Tokyo, Japan

[21] Appl. No.: 345,902

[22] Filed: Feb. 4, 1982

[30] Foreign Application Priority Data

Mar. 25, 1981 [JP] Japan ..... 56-42452
Mar. 25, 1981 [JP] Japan ..... 56-42453
Mar. 25, 1981 [JP] Japan ..... 56-42454

[51] Int. Cl.[3] ..... F02B 75/04

[52] U.S. Cl. ..... 123/54 R; 123/53 BA; 123/195 R; 123/52 A; 123/DIG. 8; 74/665 B; 180/230; 180/219; 92/146

[58] Field of Search ..... 123/54 R, 54 A, 53 R, 123/53 BA, 195 C, 195 R, DIG. 1, DIG. 6, DIG. 7, DIG. 8, 52 A, 53 C; 74/665 B; 180/228, 230, 219; 92/146, 147

[56] References Cited

U.S. PATENT DOCUMENTS 2,959,163 11/1960 Hodkin ..... 123/195 R
2,985,157 5/1961 Venediger ..... 123/51 BA
3,502,059 3/1970 Davis et al. ..... 123/195 R
3,796,048 3/1974 Annus et al. ..... 123/52 M
3,934,562 1/1976 Isaka ..... 123/53 B
4,194,469 3/1980 Kruger ..... 123/54 R

FOREIGN PATENT DOCUMENTS 0584191 10/1958 Italy ..... 123/DIG. 8

*Primary Examiner*—Craig R. Feinberg
*Assistant Examiner*—David A. Okonsky
*Attorney, Agent, or Firm*—Sughrue, Mion, Zinn, Macpeak & Seas

[57] ABSTRACT

A multi-cylinder engine for a motor vehicle comprises at least two cylinders mounted in mutually displaced relationship with respect to longitudinal and transverse directions of the vehicle. The crankshaft for one of the cylinders is located at a higher level than the crankshaft for the other cylinder. A crankcase assembly of the engine is vertically divided into pieces by a plurality of planes extending perpendicular to the crankshafts and each plane passing through each center of the cylinders. The engine provides first and second gears mounted on the primary shaft, a crank gear for one of the crankshaft, a crank gear for the other crankshaft, and an idle gear. The first gear is in meshing engagement with the crank gear for one of the crankshaft, while the second gear is connected to the other crank gear through the idle gear.

12 Claims, 7 Drawing Figures

MULTI-CYLINDER ENGINE

BACKGROUND OF THE INVENTION

1. Field of the Invention

This invention relates to an engine for a motor vehicle, particularly for a motorcycle or four-wheeled automobile. More particularly, it is concerned with a multi-cylinder engine having compact and light weight structure.

2. Description of the Prior Art

A motor land vehicle, for example, motorcycle or automobile, calls for a light and compact multi-cylinder engine which satisfies the requirements for decreased vibration, fuel economy and improved acceleration. Various proposals have hitherto been made to provide an improved multi-cylinder engine.

There is, for example, known an engine having a plurality of cylinders disposed in mutually staggered relationship. In such an engine, however, crank gears b of the respective cylinders are connected to a gear e integral with a flywheel on an output shaft by connecting gears c and d, as shown in FIG. 1 (Prior Art). This arrangement makes it difficult to reduce the distance between the crankshafts in a plane perpendicular to the cylinder centerlines. Further, since the engine employs a crankcase assembly divided in a horizontal plane, it is necessary to position the crankshafts a in alignment with a main shaft f and a counter shaft g of a transmission system in a common plane. This requires a lot of connecting gears, and a long crankcase assembly. Therefore, it has hitherto been difficult to obtain a light and compact multi-cylinder engine.

A typical multi-cylinder engine having a plurality of cylinders disposed in mutually staggered relationship is shown in U.S. Pat. No. 4,194,469.

SUMMARY OF THE INVENTION

It is, therefore, an object of this invention to overcome the above-mentioned drawbacks of the prior art, and provide an improved multi-cylinder engine.

It is another object of this invention to provide a multi-cylinder engine which is light in weight, compact in construction and easy to fabricate.

According to this invention, there is provided a multi-cylinder engine for a motor vehicle which comprises at least two cylinders mounted in mutually displaced relationship with respect to longitudinal and transverse directions of the vehicle. The crankshaft for one of the cylinders is located at a higher level than the crankshaft for the other cylinder. The engine includes a crankcase assembly divided into transversely parallel pieces by a plurality of vertical planes each passing through each of the centers of the cylinders, and extending perpendicular to the crankshafts. The crankshafts, a primary shaft and main and counter shafts in a transmission system lie in mutually different planes.

According to one embodiment of this invention, first and second gears are mounted on the primary shaft positioned adjacent to a transmission system, and a crank gear of one of the crankshafts is directly in meshing engagement with the first gear, while another crank gear of the other crankshaft is engaged with the second gear through an idle gear. According to the other embodiment, the crankshafts and the primary shafts are integrally provided with sprockets and an endless chain is trained over these sprockets to rotate the primary shaft.

Further, an intake system of one of the cylinders is positioned at one side of and adjacent to the other cylinder, and an exhaust system of the other cylinder is positioned at one side of and adjacent to the one cylinder to further render the overall engine structure compact.

DETAILED DESCRIPTION OF THE PREFERRED EMBODIMENTS

Figure 1:
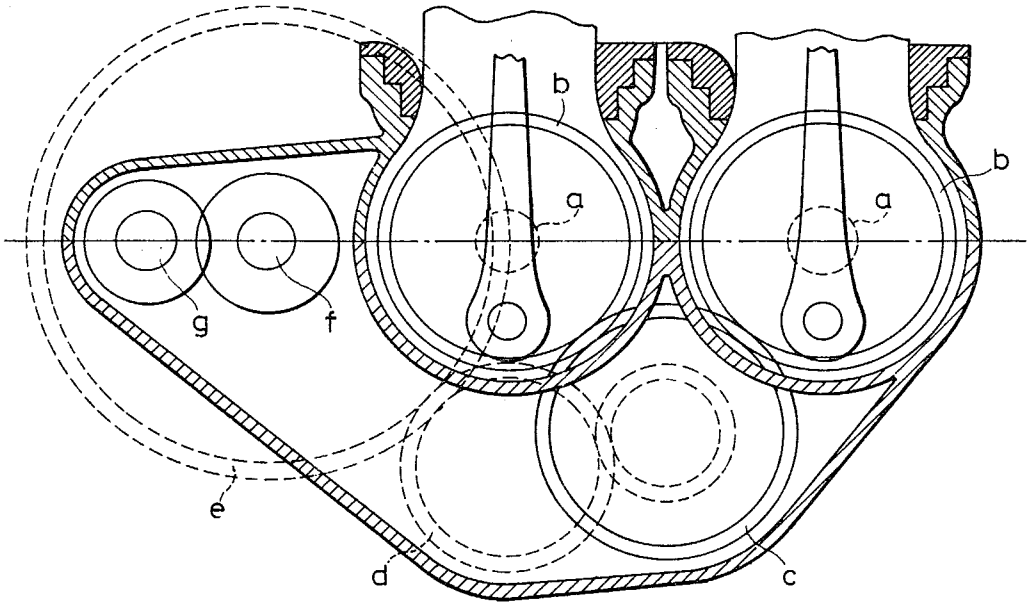
FIG. 1 PRIOR ART
FIG. 1 is a vertical cross-sectional view of a known multi-cylinder engine.
Figure 2:
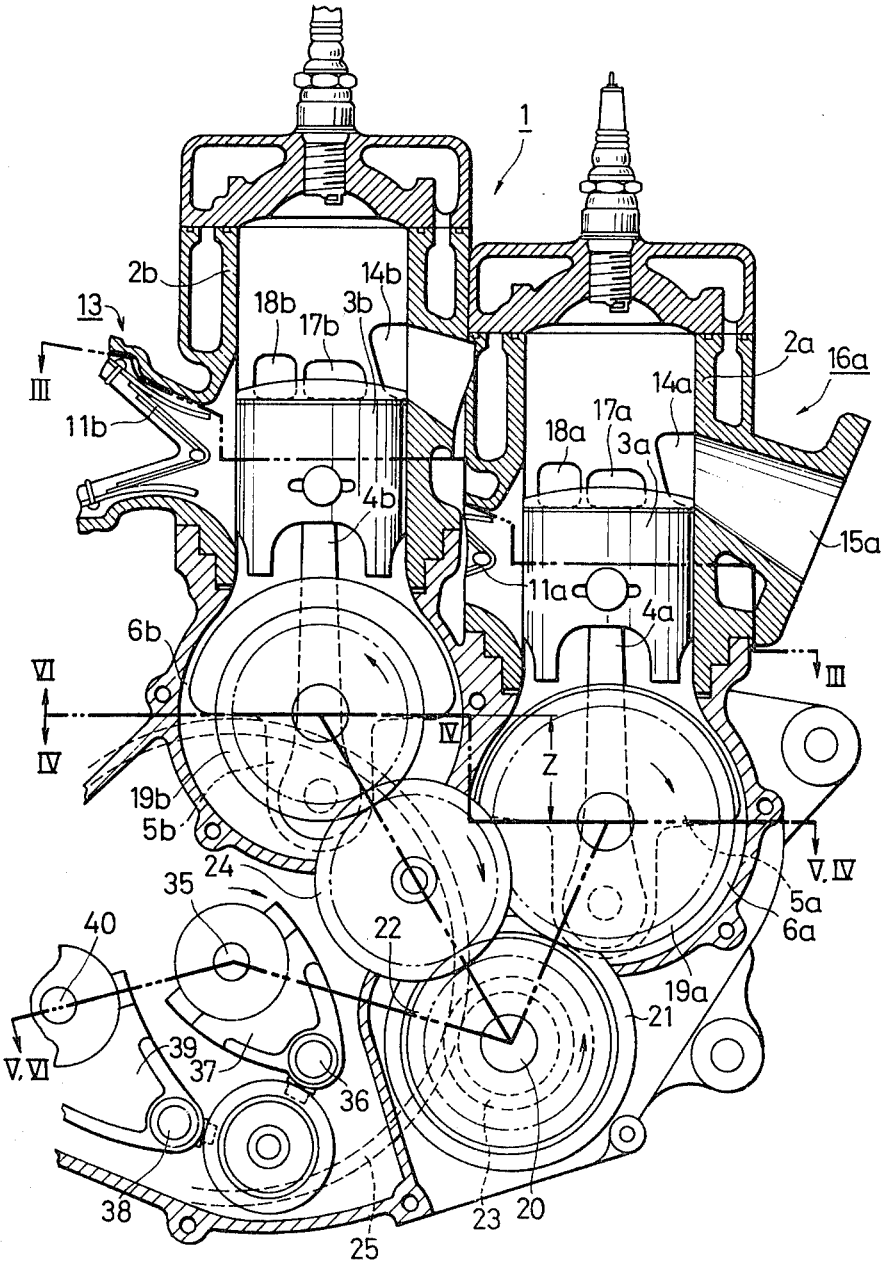
FIG. 2 is a vertical cross-sectional view of a multi-cylinder engine according to a first embodiment of this invention.
Figure 3:
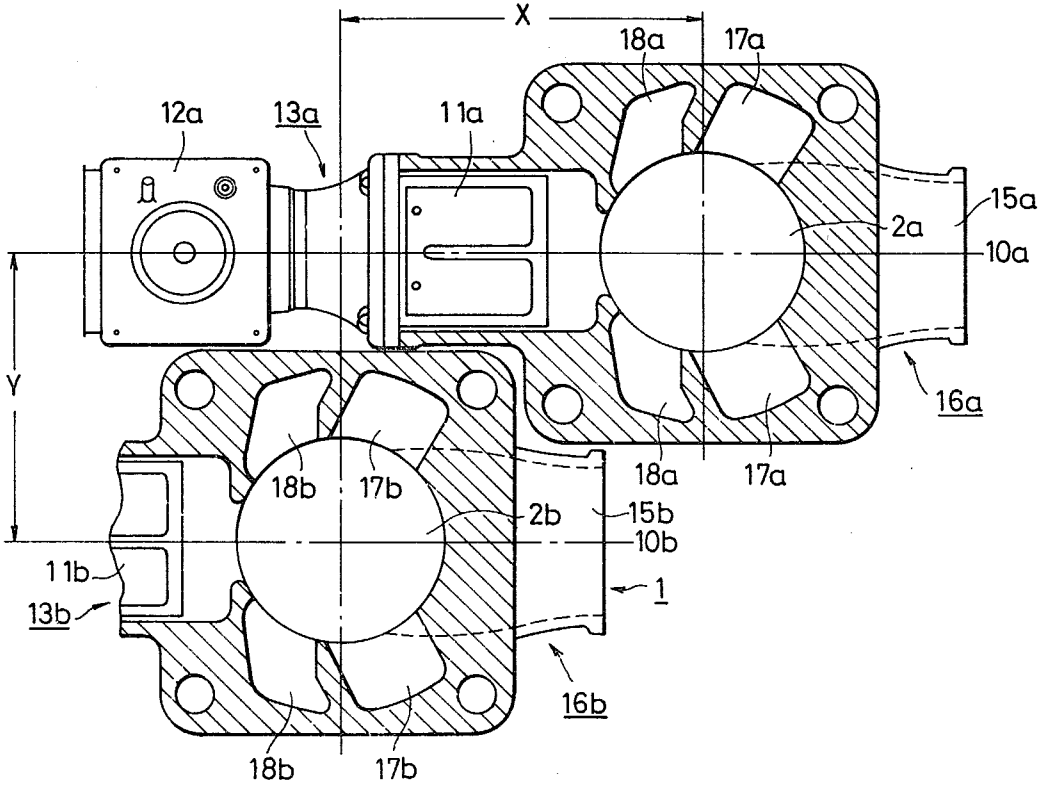
FIGS. 3 to 6 are cross-sectional views taken along the lines III—III, IV—IV, V—V and VI—VI, respectively, of FIG. 2.

Referring to FIGS. 2 to 6 of the drawings, there is shown a two-cycle, two-cylinder gasoline engine 1 for a motorcycle according to a first embodiment of this invention. An engine 1 comprises a pair of cylinders 2*a* and 2*b* displaced from each other both longitudinally of the motorcycle as shown by a pair of centerlines having a distance X therebetween, and transversely as shown another pair of centerlines having a distance Y therebetween, as shown in FIG. 3. A piston 3*a* is mounted vertically slidably in the cylinder 2*a* and a piston 3*b* in the cylinder 2*b*. The piston 3*a* is connected to a crank 5*a* in a crankcase 6*a* by a connecting rod 4*a*, and the piston 3*b* to a crank 5*b* in a crankcase 6*b* by a connecting rod 4*b*.

The rear cylinder 2*b* is situated at a higher level than the front cylinder 2*a* by a certain distance as indicated at Z in FIG. 2.

The crankcase assembly 6*a* and 6*b* are vertically divided into three portions 7, 8 and 9 by a pair of longitudinal planes 10*a* and 10*b* extending in parallel to each other through the centers of the cylinders 2*a* and 2*b*, respectively, as shown in FIGS. 3 to 6.

An intake system 13*a* including a lead valve 11*a*, which is a kind of one-way valve, and a carburetor 12*a* is provided at the rear end of the front cylinder 2*a*, while an intake system 13*b* including a lead valve 11*b* and a carburetor 12*b* is provided at the rear end of the rear cylinder 2*b*, as shown in FIG. 3. An exhaust system 16*a* including an exhaust port 14*a* and an exhaust passage 15*a* is provided at the front end of the front cylinder 2*a*, while an exhaust system 16*b* including an exhaust port 14*b* and an exhaust passage 15*b* is provided at the front end of the rear cylinder 2*b*, as shown in FIG. 2. The exhaust system 16*b* for the rear cylinder 2*b* is, therefore, located close to the front cylinder 2*a*, while the intake system 13*a* for the front cylinder 2*a* is located close to the rear cylinder 2*b*.

The cylinders 2*a* and 2*b* are connected to the crankcases 6*a* and 6*b*, respectively, by main scavenging passages 17*a* and 17*b*, and auxiliary scavenging passages 18*a* and 18*b*. The engine performs the same suction and exhaust strokes as any ordinary scavenging type engine, but may also employ any other scavenging system.

Crank gears 19*a* and 19*b* are provided at different levels of height on the right-hand side (or on this side in FIG. 2) of the cranks 5*a* and 5*b*, respectively, and connected integrally thereto. The front crank gear 19*a* is directly engaged with a first gear 21 on a primary shaft 20, while the rear crank gear 19*b* is engaged with an idle gear 24 meshing with a second gear 22 on the primary shaft 20. The crank gear 19*a* is dimensionally identical to the first gear 21, and the crank gear 19*b* to the second gear 22, whereby the cranks 5*a* and 5*b* are adapted for rotating at an equal speed, but in opposite directions.

A clutch drive gear 23 on the primary shaft 20 is engaged with a flywheel gear 25 serving also as a flywheel. A main shaft 35 for a transmission system 34 is rotatably mounted concentrical with the gear 25, which is rotatable about the shaft 35. A multiple disk friction clutch 26 (FIG. 5) is provided between the flywheel gear 25 and the main shaft 35. The clutch 26 comprises a plurality of disks 27, a center clutch 29, a plurality of plates 28, a clutch lifter 30, a coil spring 31 and a lifter rod 32. The disks 27 are formed integrally with the flywheel gear 25, and the center clutch 29 is keyed or splined to the main shaft 35. The plurality of plates 28 are formed integrally with the center clutch 29 and disposed between the disks 27. The clutch lifter 30 cooperates with the center clutch 29 to hold the disks 27 and the plates 28. The coil spring 31 urges the clutch lifter 30 toward the center clutch 29. The lifter rod 32 is provided with a clutch cam 33 adapted to move the center clutch 29 to the left (or upwardly in FIG. 5) for disengaging the clutch. The clutch cam 33 has a cam surface which causes the clutch 26 to be engaged by the biasing force of the coil spring 31 when a cam projection is oriented downwardly, while the clutch 26 is disengaged when the cam projection faces to the left (or oriented upwardly in FIG. 5).

The transmission 34 further includes a pair of gear shift shafts 36 and 38 and a pair of gear shift forks 37 and 39 adapted to be driven by the shafts 36 and 38, respectively, as shown in FIG. 2. Multiple stage speed change is conducted between the main shaft 35 and a counter shaft 40 (FIG. 5) in response to the axial movement of the forks 37 and 39.

Figure 5:
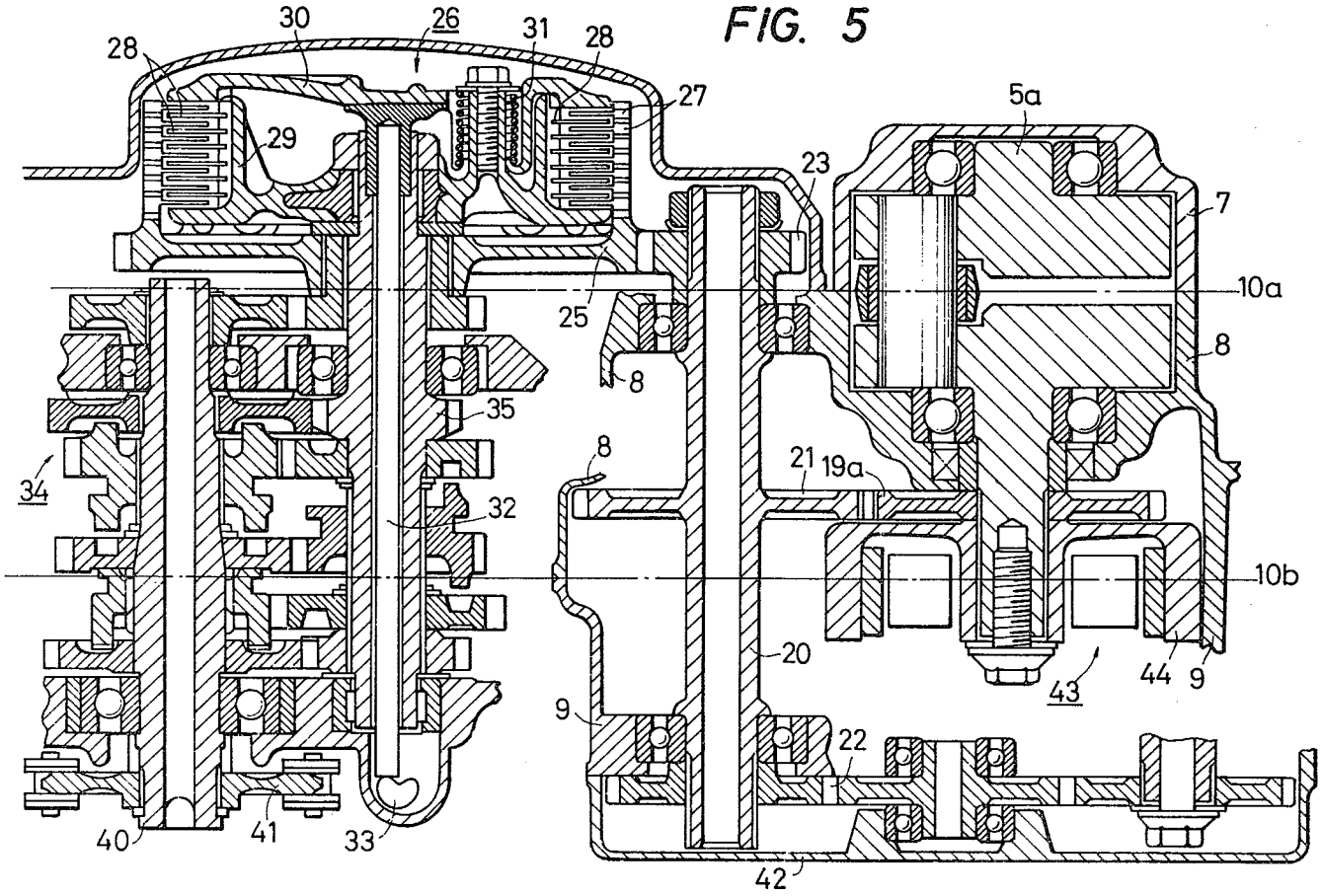

A chain drive sprocket 41 is connected integrally with the counter shaft 40 as shown in FIG. 5, and is also connected by a chain to a chain sprocket (not shown) for a rear wheel.

Figure 6:
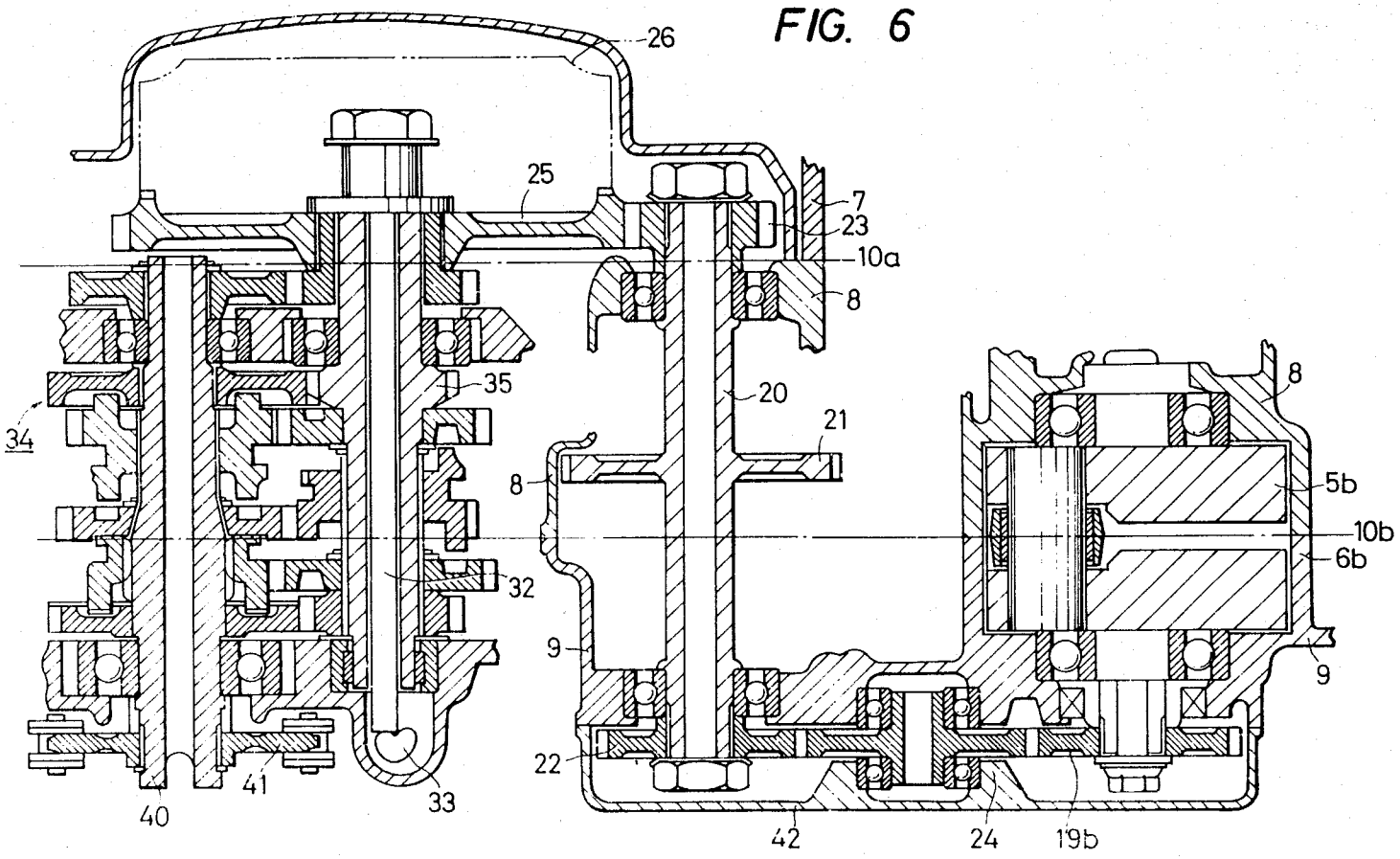

An auxiliary cover 42 is detachably provided to the right casing 9 shown at the bottom of FIG. 6 so as to cover the crank gear 19*b*, the second gear 22 on the primary shaft 20 and the idle gear 24.

Figure 4:
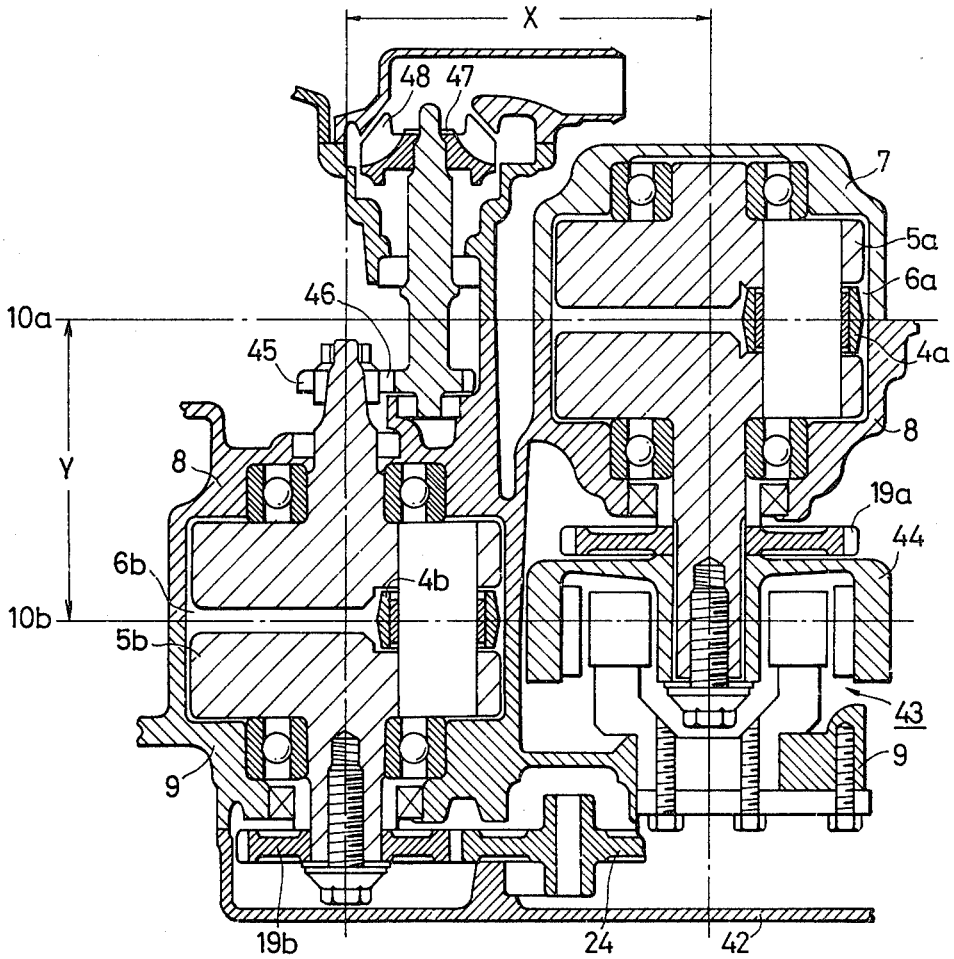

A rotor 44 for an AC generator 43 is provided on the opposite or right side of the front crank 5*a* with respect to the crank gear 19*a* and is connected coaxially with the crank 5*a*, as shown in FIG. 4. A drive pinion 45 is connected coaxially and integrally with the left end of the rear crank 5*b*, and a gear 46 is engaged with the pinion 45. A pump impeller 48 is formed integrally and coaxially with the gear 46, so that the rotation of the rear crank 5*b* is transmitted to the impeller 48 to drive a pump 47 for circulating cooling water.

If a starter (not shown) is actuated to start the engine 1, the front crank 5*a* rotates, for example, in clockwise direction as viewed in FIG. 2, while the rear crank 5*b* rotates in the opposite direction, but at the same speed as the front crank 5*a*.

The rotation of the front crank 5*a* is transmitted to the main shaft 35 in the transmission 34 through the crank gear 19*a*, the first gear 21, the primary shaft 20, the clutch drive gear 23, the flywheel gear 25 and the multiple disk friction clutch 26. After the speed of rotation has been reduced by the transmission 34 at an appropriate gear ratio, the rotation is transmitted to the chain sprocket 41 and the rear wheel through the chain (not shown) and the chain sprocket (not shown) integral with the rear wheel whereby the motorcycle is about to run.

The rotation of the rear crank 5*b* is transmitted to the primary shaft 20 through the crank gear 19*b*, the idle gear 24 and the second gear 22. It is eventually transmitted to the rear wheel as has been described with respect to the transmission of the rotation of the front crank 5*a*.

With the operation of the engine 1, a fuel-air mixture is introduced into the cylinders 2*a* and 2*b* through the carburetors 12*a* and 12*b*, the lead valves 11*a* and 11*b*, the crankcases 19*a* and 19*b*, and the scavening passages 17*a* and 17*b* and 18*a* and 18*b*, while the combustion gases are exhausted from the cylinders 2*a* and 2*b* through the exhaust ports 14*a* and 14*b* and the exhaust pipes 15*a* and 15*b*.

The intake systems 13*a* and 13*b* for the two cylinders 2*a* and 2*b* are positioned on the rear side of the engine 1 in parallel to each other, while the exhaust systems 16*a* and 16*b* are provided on the front side of the engine 1 in parallel to each other. Accordingly, these systems can be accommodated compactly in a limited space.

Insofar as the cranks 5*a* and 5*b* are associated with the primary shaft 20 in the positional relationship as shown in FIG. 2, the vibrations of the cylinders 2*a* and 2*b* which occur longitudinally of the motorcycle are cancelled by each other.

The staggered relationship of the cylinders 2*a* and 2*b* as shown in FIG. 3 contributes to diminishing the overall dimensions of the engine 1 both longitudinally and transversely of the motorcycle. The location of the rear cylinder 2*b* at a higher level than the front cylinder 2*a* as indicated by Z in FIG. 2 contributes to further reduction in the dimensions of the engine 1 longitudinally of the motorcycle.

Since the idle gear 24 is provided between the crank gear 19*b* and the second gear 22 on the primary shaft 20, the main shaft 35 in the transmission 34 can be positioned closer to the front portion of the engine, so that it is possible to diminish the overall dimensions of the engine 1 and the transmission 34.

While the front crank gear 19*a* is engaged with the first gear 21 on the primary shaft 20, the rear crank gear 19*b* is connected with the second gear 22 on the primary shaft 20 by the idle gear 24, and these are surrounded by the auxiliary cover 42. If the auxiliary cover 42 and the idle gear 24 are removed, it is easily possible to change the crank angles of the front and rear cylinders 2*a* and 2*b* appropriately to thereby alter the explosion timing thereof.

As the crankcase assembly 6*a* and 6*b* are vertically divided into three portions by the vertical planes 10*a* and 10*b* extending perpendicularly to the crankshafts through the centerlines of the cylinders 2*a* and 2*b*, respectively, it is not necessary to position the shafts of the cranks 5*a*, 5*b*, the primary shaft 20, the main shaft 35 in the transmission 34 and the counter shaft 40 in a common plane. These shafts can be positioned in any location relative to one another so that the engine and the transmission 34 as a whole may be of compact construction. The engine 1 is, thus, easy to fabricate, light in weight, and yet high in rigidity.

Figure 7:
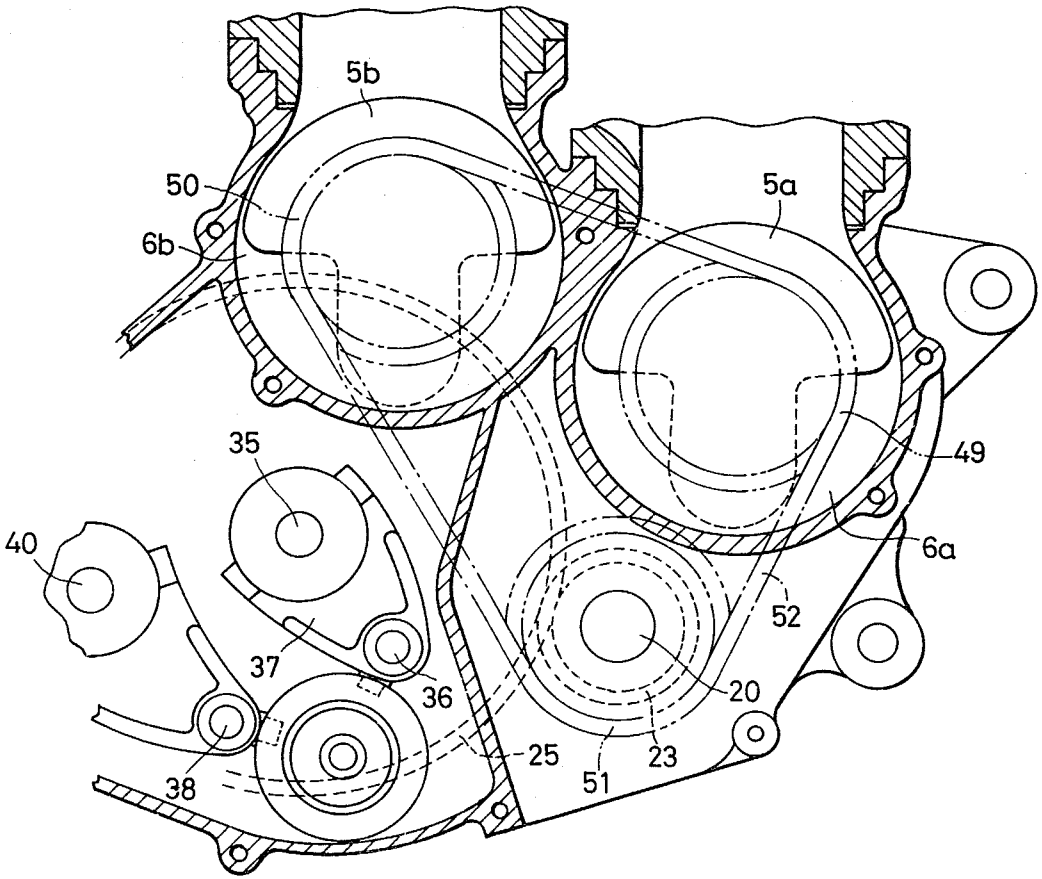
FIG. 7 is a cross-sectional view showing an essential portion according to a second embodiment of this invention.

A second embodiment of this invention is shown in FIG. 7. According to the first embodiment, the front crank 5*a* is connected to the primary shaft 20 through the crank gear 19*a* and the first gear 21, and the rear crank 5*b* to the primary shaft 20 through the crank gear 19*b*, the idle gear 24 and the second gear 22. According to the second embodiment, by contrast, chain sprockets 49, 50 and 51 are provided on the cranks 5*a* and 5*b*, and the primary shaft 20, respectively, and an endless chain 52 is trained over the sprockets 49 to 51, as shown in FIG. 7. The second embodiment operates substantially in the same way as the first embodiment, except that in the engine according to the second embodiment the cranks 5*a* and 5*b* rotate in the same direction.

Although the engines according to the first and second embodiments both include two cylinders, it is also possible to apply the invention to an engine having three or more cylinders. Transverse symmetry may be realized in an engine having an odd number of cylinders. Although in both of the embodiments the cylinders are parallel to each other, the invention is also applicable to an engine having front and rear cylinders positioned at an angle to the planes which are perpendicular to the crankshafts. Although both of the embodiments are directed to a two-cycle gasoline engine, the invention is also applicable to a four-cycle gasoline engine, or a two- or four-cycle diesel engine. Although in the embodiments hereinabove described, the intake systems are provided on the rear side of the cylinders, and the exhaust systems on the front side thereof, their positions can be reversed.

This invention provides a lot of advantages as will hereinafter be summarized:

(a) The engine of this invention is small and compact both longitudinally and transversely of the vehicle and light in weight, since at least two cylinders are displaced from each other both longitudinally and transversely of the vehicle.

(b) Since the crankshaft for one cylinder is positioned at a higher level than that for another, the distance between the front and rear cylinders can be reduced, and the structural members associated with those cylinders can be formed integrally, so that the engine may be further lighter in weight and more compact in construction.

(c) Since the crankcase assembly is vertically divided into pieces by a plurality of planes extending through the centers of cylinders and perpendicularly to crankshafts, and since every neighbouring cylinders are mounted in mutually displaced relationship both longitudinally and transversely of the vehicle, it is not necessary to position various shafts, such as the crankshafts, or the main and counter shafts in the transmission in a common plane. The shafts can be positioned in any axially offset relationship to one another both longitudinally and transversely of the vehicle. The cylinders may be mounted in parallel to each other, or in staggered relationship at an angle to each other (for example, as in a V-type engine), when viewed in a plane perpendicular to the crankshaft. Therefore, the engine of this invention is small in crankcase width and length, compact in construction, and light in weight.

(d) Since the crankcase assembly is vertically divided into pieces by a plurality of planes extending through the centers of cylinders and perpendicularly to the crankshafts, these pieces can be produced by casting to provide an integral assembly having a number of parallel divided portions whose number is one greater than the number of the cylinders disposed along the crankshafts, and planner end surfaces of each piece can be machined to present parallel planes. Therefore, the engine is easy to fabricate with high machinability and accuracy.

(e) The engine is light in weight and high in rigidity, since the crankcases for the neighbouring cylinders are formed integrally with each other.

(f) Since the clutch, etc. are mounted in one of the crankcases, it is possible to expose the clutch, etc. without dismantling the whole crankcase assembly if the outermost portion covering the clutch, etc. is removed. This arrangement ensures efficiency in the maintenance and inspection of the clutch, etc.

(g) Since the engine comprises at least two cylinders displaced from each other longitudinally of the vehicle, and since the gear on the crankshaft for one cylinder is directly engaged with the first gear on the primary shaft, while the gear on the crankshaft for another cylinder is connected with the second gear on the primary shaft through the idle gear, it is possible to alter the heights of the cylinders relative to each other to thereby shorten the distance between the front and rear cylinders. Therefore, the engine is light in weight and compact in construction.

(h) If required is the change of the explosion timing of the cylinders relative to each other in order to alter the engine characteristics, it is possible to achieve this very easily without dismantling the crankcase assembly. That is, after removing the idle gear, the crank angles of the cylinders are altered relative to each other, and the idle gear is assembled again.

(i) Since the intake system for one cylinder is located on one side of and adjacent to the other cylinder, and the exhaust system for the other cylinder on one side of and adjacent to the one cylinder, the exhaust systems for all the cylinders can be positioned on one side of the engine and their intake systems on the other side thereof. Therefore, the engine is compact in construction.

Although the invention has been described with reference to preferred embodiments thereof, it is to be understood that this invention is not limited by those embodiments, but that variations or modifications may be easily made by anybody of ordinary skill in the art without departing from the spirit and scope of this invention as defined by the appended claims.

What is claimed is:

1. A multi-cylinder engine comprising a plurality of vertically displaced cylinders having substantially equal lengths, crankshafts with substantially equal throws and a crankcase assembly, said crankcase assembly being vertically divided into pieces by a plurality of planes extending through centers of said cylinders, respectively, and perpendicularly to said crankshafts, respectively, every neighbouring cylinders being mounted in mutually displaced relationship longitudinally and transversely of a vehicle in which said engine is mounted.

2. A multi-cylinder engine as defined in claim 1, wherein the number of said pieces of said crankcase is one greater than the number of said cylinders.

3. A multi-cylinder engine comprising at least two parallel cylinders each having substantially equal length and an independent combustion chamber mounted in mutually displaced relationship longitudinally and transversely of each other in a vehicle in which said engine is mounted, a piston mounted for reciprocation in each cylinder and a first crankshaft operably connected to one of said pistons and a second crankshaft operatively connected to the other of said pistons with one of said crankshafts being located at a higher level than the other crankshaft wherein said crankshafts have substantially equal throws.

4. A multi-cylinder engine as defined in claim 3 further comprising first and second sprockets mounted on said first and second crankshafts respectively, a sprocket mounted on said primary shaft and an endless chain trained over said sprockets.

5. A multi-cylinder engine as defined in claim 3 further comprising a crankcase assembly, said crankcase assembly being vertically divided in two pieces by a plurality of planes extending through the centers of said cylinders respectively and perpendicularly to said crankshafts respectively.

6. A multi-cylinder engine as defined in claim 5 further comprising a primary shaft disposed parallel to said first and second crankshafts and having first and second gears mounted thereon, a first crankshaft gear mounted on said first crankshaft and disposed in meshing engagement with said first gear, a second crankshaft gear mounted on said crankshaft and an idle gear disposed between and in meshing engagement with said second crankshaft gear and said second gear.

7. A multi-cylinder engine as set forth in claim 3 further comprising a primary shaft disposed parallel to said first and second crankshafts, first and second gears mounted on said primary shaft, a first crankshaft gear mounted on said first crankshaft and disposed in meshing engagement with said first gear, a second crankshaft gear mounted on said second crankshaft and an idle gear disposed in meshing engagement with said second crankshaft gear and said second gear.

8. A multi-cylinder engine as defined in claim 7 further comprising a transmission disposed adjacent said engine and having a plurality of shafts disposed parallel to said primary shaft and gear means operatively connecting said primary shaft to one of said shafts in said transmission wherein said first and second crankshafts, said primary shaft and said shafts in said transmission lie in mutually different horizontal planes.

9. A multi-cylinder engine as defined in claim 7 wherein the diameters of said first and second crankshaft gears and first and second gears are equal to one another.

10. A multi-cylinder engine as defined in claim 7 further comprising a crankcase enclosing said first and second crankshafts, said primary shaft, said first gear, and said first crankshaft gear, said second crankshaft gear, said idle gear and said second gear being positioned outside of said crankcase and an auxiliary cover mounted on said crankcase for covering said second crankshaft gear, said idle gear and said second gear.

11. A multi-cylinder engine as defined in claim 10 wherein said auxiliary cover is detachably mounted on said crankcase and said idle gear is removably mounted to control the crankshaft angle relative to said cylinder.

12. A multi-cylinder engine as defined in claim 3 or 1 further comprising an intake system for one of said cylinders positioned at one side of and adjacent to the other of said cylinders and an exhaust system for the other of said cylinders being located at one side of and adjacent to said one of said cylinders.

* * * * *